US006736934B1

(12) United States Patent
Henricson et al.

(10) Patent No.: US 6,736,934 B1
(45) Date of Patent: May 18, 2004

(54) METHOD OF PRETREATING PULP IN AN ACID TOWER PRIOR TO BLEACHING WITH PEROXIDE

(75) Inventors: Kaj Henricson, Helsinki (FI); Olavi Pikka, Karhula (FI)

(73) Assignee: Andritz Oy, Helsinki (FI)

( * ) Notice: Subject to any disclaimer, the term of this patent is extended or adjusted under 35 U.S.C. 154(b) by 826 days.

(21) Appl. No.: 08/875,424

(22) PCT Filed: Feb. 16, 1996

(86) PCT No.: PCT/FI96/00090

§ 371 (c)(1),
(2), (4) Date: Jul. 28, 1997

(87) PCT Pub. No.: WO96/25552

PCT Pub. Date: Aug. 22, 1996

(30) Foreign Application Priority Data

| | | |
|---|---|---|
| Feb. 17, 1995 | (FI) | 950749 |
| Jun. 7, 1995 | (SE) | 9502087 |
| Jun. 20, 1995 | (FI) | 953064 |
| Jul. 6, 1995 | (FI) | 953343 |
| Sep. 19, 1995 | (FI) | 954407 |

(51) Int. Cl.[7] ..... D21C 9/14; D21C 9/147; D21C 9/16; D21C 9/18; D21C 9/02

(52) U.S. Cl. ..... 162/19; 162/52; 162/56; 162/60; 162/65; 162/67; 162/76; 162/78; 162/88

(58) Field of Search ..... 162/76, 78, 65, 162/88, 89, 66, 67, 60, 19, 56, 52

(56) References Cited

U.S. PATENT DOCUMENTS 5,431,781 A * 7/1995 Walsh ..... 162/76

FOREIGN PATENT DOCUMENTS

| | | | |
|---|---|---|---|
| CA | 1206704 | 7/1986 | |
| EP | 0433138 | 6/1991 | |
| EP | 0622491 | 11/1994 | |
| GB | 1062734 | 3/1964 | |
| JP | 57-21591 | * 2/1982 | ..... 162/76 |
| WO | WO 94/12721 | 6/1994 | |
| WO | 94/20674 | * 9/1994 | ..... 162/76 |
| WO | WO 94/29512 | 12/1994 | |

OTHER PUBLICATIONS

Marechal, Journal of Wood Chemistry and Tech., 13(2), pp. 2612–81, 1993.

* cited by examiner

*Primary Examiner*—Steve Alvo
(74) *Attorney, Agent, or Firm*—Nixon & Vanderhye P.C.

(57) ABSTRACT

The present invention relates to a method of pretreating, by acidification and chelation, of pulp to be bleached with peroxide. Especially, the invention relates to intensifying, and at the same time simplifying the pretreatment required by peroxide bleaching. It is characteristic of the invention to introduce pulp into an acid tower (14, 112) where the pressure is 0 to 20 bar, preferably 1 to 10 bar, and the temperature 75 to 130° C. preferably 80 to 110° C., to treat the pulp in acid tower (14, 112) at a pH of 2 to 6, preferably 3 to 4, for 20 to 240 minutes, for decreasing the kappa number by 1–9, preferably 2–6 kappa units, to transfer the pulp from acid tower (14, 112) to a tower (24) of a second treatment stage, to treat the pulp with either a complexing agent at a pH of 4 to 9, preferably 5 to 6, or with an oxidizing chemical such as chlorine dioxide, Caro's acid, peracids or equivalent, and to wash and/or press the pulp.

19 Claims, 3 Drawing Sheets

METHOD OF PRETREATING PULP IN AN ACID TOWER PRIOR TO BLEACHING WITH PEROXIDE

BACKGROUND AND SUMMARY OF THE INVENTION

The present invention relates to a method of bleaching pulp with peroxide. The invention especially relates to intensifying and at the same time simplifying the pretreatment required by peroxide bleaching.

Bleaching of pulp with peroxide is previously known in many connections. Especially in bleaching of chlorine-free pulp, peroxide has an important role. Prior to peroxide bleaching, it is necessary to remove heavy metals from the pulp by utilizing, for example, complexing agents such as EDTA or DTPA. It has been established in tests that a suitable pH value is 4 to 7, preferably 5 to 6, in this so-called chelating stage.

On the other hand, it has been surprisingly established (FI 944808) recently that the kappa number of pulp may be decreased by mere acid in a pH range of 2 to 6, preferably 3 to 4. The temperature has to be 60 to 130° C. and the duration 20 to 240 minutes in this, so-called acidifying treatment. A suitable acid is aminic acid, sulphuric acid, or hydrochloric acid, even though other corresponding acids may be considered as well. In other words, we have found that, besides peracids suggested in Swedish patent 500605, which, as known, contain a delignifying perhydroxyl ion, a suitable acid may be some acid which does not contain any known delignifying ion or equivalent. A prerequisite for operation without peracids or equivalent is that the temperature is high enough (cf. FI 944808). Peracids and equivalent do not call for high temperatures; usually a temperature below 75° C., most usually that of 50 to 75° C., is sufficient. Treatment with acid may be intensified with additional chemicals, but it is once more to be noted that it is not at all necessary for decreasing the kappa number. Such additional chemicals are those which make the treatment of metals more effective or more effectively decrease the kappa number.

It has been often thought that acidification (A) and chelation (Q) stages could be united, but practical experience has shown that it is impossible. The pH ranges of acidification and chelation deviate from each other and, therefore, two separate treatment towers are necessary. At the acidification (A) stage, the pH has to be low enough, the temperature high enough and the treatment time long enough. At the chelation stage (Q), however, the pH has to be high enough. It is an object of this invention to provide a method of implementing acidification, decrease of the kappa number, and chelation, as simply and efficiently as possible, excluding unnecessary pumping operations.

It is previously known that prior to peroxide bleaching, the pulp is treated at a ZQ stage where, at the Z stage it is delignified with ozone at a pH of 2 to 4 and, thereafter, treated at the Q stage for removing metals. However, there is a problem of the Z stage being fast, usually taking less than 1 minute, and often cold, below 70° C. The Z stage thereby provides poor conditions for dissolving metals from fibers. This may be partly remedied by adding an A stage prior to the ozone treatment so that an AZQ stage, i.e., an arrangement with three towers, is brought about. This arrangement involves two problems in view of dissolving metals. One is the temperature and the other concerns removal of heavy metals; the best way of removing heavy metals is to provide extracting time for pulp after delignification. In other words, with regard to metals removal, the ZQ stage should be an AZAQ stage, i.e., an arrangement with four towers, which should be run at a high temperature of preferably over 70° C. But a further problem is involved in here, namely the ozone treatment produces radicals which are harmful to the pulp quality and which have enough time so as to react with pulp in the second A tower.

In Tappi Pulping Conference held in 1994, Nordgren and Elofson suggested in their paper "New process for metal ion chelation at elevated pH in pulp production" including an AQ stage for removal of metals. According to their teaching, the pH is 3 to 5 at the A stage and 6 to 9 at the Q stage. They suggest that the temperature of the process be 75° C., which is too low in view of decreasing the kappa number. A weakness of the method by Nordgren and Elofson is thereby that after their AQ stage, the bleachability of the pulp is still rather poor since the kappa number has not been lowered at the A stage, which impairs dissolving of metals and weakens the bleachability.

In the 1994 Tappi Pulping Conference, the article "Metal management in ECF bleaching and the effect of peroxide efficiency in the EPO stage" studied the effect of chelating agents when these were added to the chlorine dioxide stage. It is established in the study that, chelating agents, when added to the chlorine dioxide stage, do not lessen delignification at the chlorine dioxide stage, but delay the increase of brightness instead. The EPO stage functions better if chelating agents are added to the chlorine dioxide stage preceding the EPO stage. So, it is suggested in the article that the $D_QE_{PO}$ sequence may be improved by converting it into a $DQE_{PO}$ sequence, by adding one treatment stage, i.e., a Q stage. The research had been made using the temperature of 60° C. at the D stage, which is too low in practice. The kappa number was also too high, i.e., nearly 30.

It is a characteristic feature of a preferred embodiment of the method of the present invention that, prior to the peroxide stage which is preferably pressurized, most preferably a pressurized two-tower peroxide stage, pulp is treated at a two-tower treatment stage where the kappa number of pulp is lowered in acidic, hot conditions, the pH being preferably 2 to 6 and the temperature 75 to 130° C., and thereafter at a chelation stage, the pH being 4 to 9 preferably 5 to 6. Hereby, the bleachability of pulp is made optimal with regard to both metals and the kappa number prior to the peroxide stage.

It is a characteristic feature of another, alternative embodiment of the method of the invention that pulp, the kappa number of which has been lowered with a hot acid treatment, is treated with chlorine dioxide or some peracid at the same bleaching stage, but in a separate tower.

The characteristic features of the method of the invention appear from the accompanying claims.

DETAILED DESCRIPTION OF THE DRAWINGS

Figure 1:
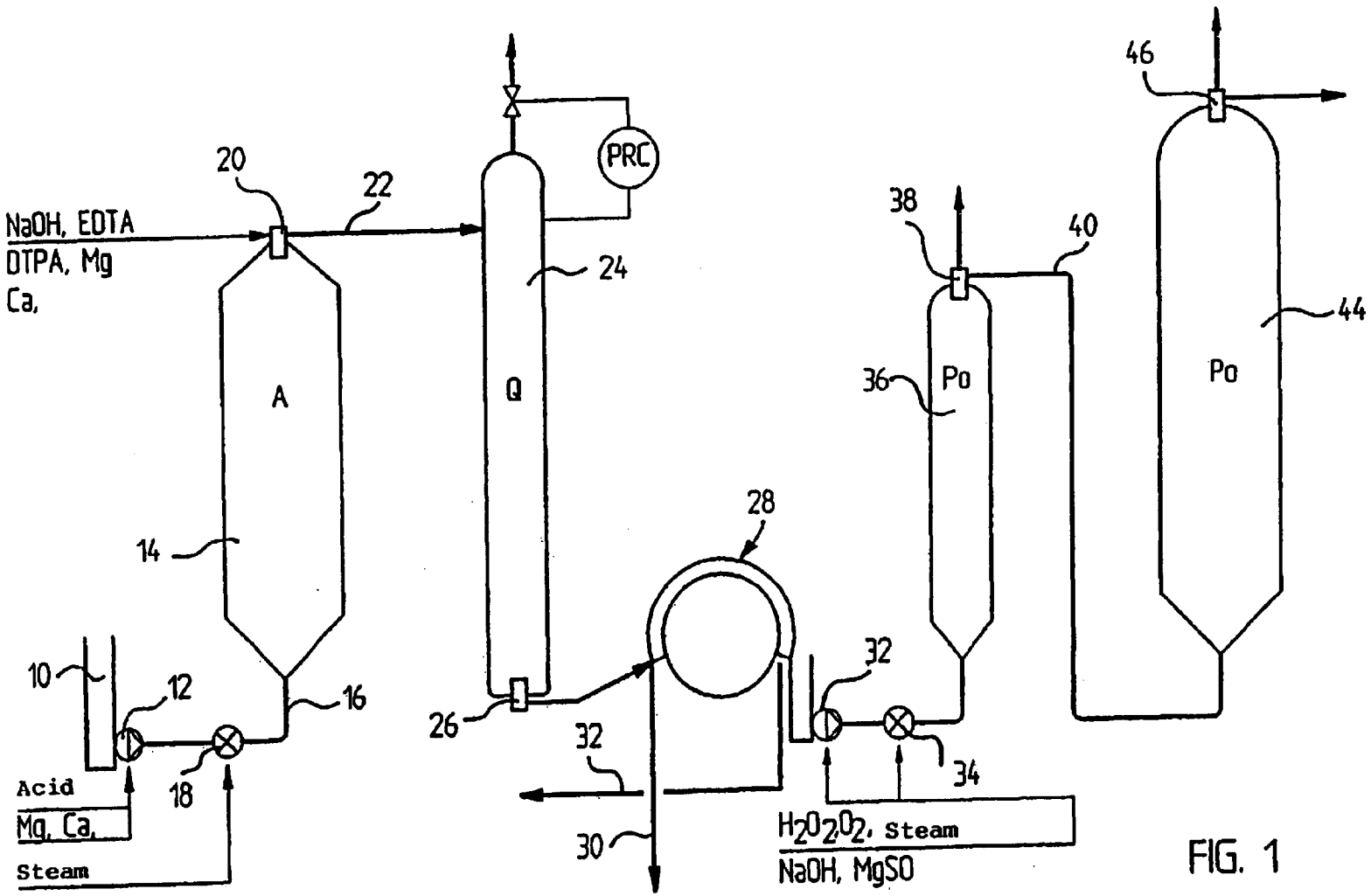
FIG. 1 illustrates an installation according to a preferred embodiment of the invention.

In the embodiment of FIG. 1, pulp is transferred from a preceding treatment stage 10 by an MC® pump 12 to an acid tower 14. The preceding treatment stage may be oxygen delignification, which most usually follows pulp cooking, washing subsequent to that, or some other delignification or bleaching stage, or washing subsequent to that. Before tower 14, necessary chemicals are added to the pulp and, if necessary, steam is added for raising the temperature. These chemicals are the acids mentioned above (e.g. hydrochloric acid, sulphuric acid, or aminic acid, i.e., acid which does not contain oxidizing perhydroxyl ion) and, e.g., enzymes, magnesium and/or calcium, which are added as $MgSO_4$ and/or CaO. It is possible to add the chemicals either directly to pump 12, to inject them into a tube 16 between pump 12 and tower 14, or into a mixer 18 specifically arranged for this purpose. The conditions in the acid tower 14 are as follows: pressure 0 to 20 bar, preferably 1 to 10 bar; temperature 75 to 130° C., preferably 80 to 110° C.; and pH 2 to 6, preferably 3 to 4. Treatment in the acid tower takes 20 to 240 minutes, preferably 45 to 150 minutes. The kappa number usually decreases by 1–9 units, most usually by 2–6 units, in the acid tower.

After the acidification, chemicals needed in chelating are added to the pulp. Such chemicals are a complexing agent, e.g., EDTA and DTPA, and potentially metals, such as magnesium and lime. Metals may advance chelation. Enzymes may be used as well. Chelation purposes to remove heavy metals which catalyze degradation of hydrogen peroxide, such as manganese and copper. A suitable pH value for chelation is 4 to 9, preferably 5 to 6. If the pH after acidification is in a range which is unsuitable for chelation, the pH is adjusted to a suitable value by adding either acid or alkali (NaOH). Addition of NaOH is usually necessary in order to raise the pH from the level prevailing in acidification. A suitable place for adding these chemicals is a discharge means 20 of the acid tower, i.e., a so-called A tower, or a subsequent transfer line 22, between the acid and chelating towers 14, 24. A portion of the chemicals may be added already in the A stage, e.g., $MgSO_4$, EDTA, DTPA. The main thing is that they are present when the Q stage begins and the pH is raised.

By the pressure developed by A tower 14, or actually by feed pump 12, pulp is transferred to Q tower 24. Thus, the A stage and the Q stage use two separate towers 14 and 24 without any pumping needed between the towers. Pulp discharge means 20 may be so designed that it mixes chemicals and/or raises the pressure. In FIG. 1, A tower 14 is an upflow tower as well as Q tower 24. Towers 14 and 24 may be either of upflow or downflow types, depending on the circumstances. In some cases, pulp may also be transferred by mere gravity from the A tower to the Q tower.

In Q tower 24, pulp is chelated. The conditions are as follows: retention time at least 10 to 60 minutes at the pH of 4 to 9, preferably 5 to 6. The temperature and pressure have not been established to have much effect on the chelating process, even though the Q tower may be pressurized. The treatment time in Q tower 24 is not critical either, but it may be even several hours longer than that mentioned before, for example, when Q tower 24 is used as a storage tower for pulp, i.e., a conventional high consistency pulp tower.

After Q tower 24, pulp is washed and/or pressed. Pressing refers to a washing method, in which liquid and various substances dissolved and extracted therein in acidification and chelation of pulp and produced by different reactions are pressed from the pulp coming from, e.g., tower 24 at a medium consistency of 10–14% so that the pulp consistency rises to >30%, whereafter the pulp is diluted back to the medium consistency range. FIG. 1 shows a washer 28, whereinto pulp is discharged from tower 24 either by pressure of tower 24 or by a bottom discharge means 26 which raises the pressure; in any event without a separate pump. Washer 28 is preferably a so-called fractionating washer, which means that several filtrates of different consistencies are obtained from the same washer. A so-called DRUM DISPLACER® washer disclosed, e.g., in U.S. Pat. Nos. 4,919,158 and 5,116,423 is a fractionating washer. One of the filtrates produced in washer 28, preferably filtrate F1, rich in heavy metals, is removed via a tube 30 and the other, F2, is returned via a tube 31, for example, to a washer preceding the A stage. Thus, the AQ stage is partly closed.

After washing with washer 28, the pulp is bleached with peroxide. It is advantageous to use a pressurized reactor, especially a twin vessel reactor, as illustrated in FIG. 1. Irrespective of the reactor type, a suitable peroxide dosage is 5 to 20 kg of $H_2O_2$/adt and, depending on the kappa level, 0 to 15 kg/adt of oxygen, preferably about 5 kg/adt may be added. Also alkali is added to the peroxide stage, for raising the pH and, if necessary, magnesium is added, for example, in form of magnesium sulphate. The temperature is 90 to 130° C. The peroxide stage may be preceded by some other bleaching stage, e.g., ZQ stage. On coming to the P stage, the pulp has a kappa number which is preferably below 10, often below 6.

In the method utilizing a twin vessel reactor, pulp is pumped at a medium consistency with MC® pump 32 via mixer 34, if desired, to a pretreatment reactor 36, which is designed for a treatment time of 10 to 60 minutes. The pressure in the reactor is 3 to 20 bar, preferably about 10 bar. Bleaching chemicals $H_2O_2$ and oxygen are fed to pump 32 or mixer 34. The peroxide dosage is 5 to 20 kg/adt, preferably about 10 kg/adt. The oxygen dosage is usually 0 to 15 kg/adt, preferably about 0 to 10 kg/adt, most preferably about 3 to 5 kg/adt. The temperature is 80 to 110° C., preferably 90 to 100° C.

In pretreatment reactor 36, peroxide reacts quickly and, after about 30 minutes, 75% of the peroxide has been consumed. This means also that 75% of the reaction gases have been generated. Therefore, a gas separator 38 is installed on top of pretreatment reactor 36, for separating gas from the pressure space of reactor 36. The separating capacity of this separator 38 is 40 to 90% of the gas volume contained in the pulp. The pulp which is still under pressure after gas separation is taken via a tube 40 to the bottom of the bleach tower 44 itself, where the pulp flows upwardly by its own pressure, with-out a separate pump. The bleach tower 44 need not necessarily be pressurized; any existing tank of a suitable size is applicable. However, it is advantageous to maintain a slight over-pressure, i.e., 1.1 to 5 bar, in the bleach tower. A suitable retention time in tower 44 is 30 to 200 minutes. Additional chemicals may be applied on pulp between towers 36 and 44 either via mixer (not disclosed) or, for example, by injecting them. After the bleaching reactions have taken place, the pulp has ended up in the top section of tower 44, and flows as a result of height difference to the following treatment stage, without a pump. As tower 44 is pressurized, its discharge opening may be provided with a gas separator 46, for removing gases formed by the peroxide reaction, and if the gas separator raises the pressure, the additional pressure generated by it may be utilized for further feeding of the pulp.

The most preferred sequences applying the method of the invention are the following:

| | |
|---|---|
| Cooking - O - AQ - P | (brightness over 80), |
| Cooking - AQ - ZP | (brightness over 83), |
| Cooking - O - AQ - P - AQ - P | (brightness over 83), |
| Cooking - O - AQ - P - ZQ - P | (brightness over 88), |
| Cooking - O - AQ - ZQ - P - ZP | (brightness over 88), |
| Cooking - O - AQ - P - ZP | (brightness over 88), |
| and | |
| Cooking - O - AQ - ZQ - P | (brightness over 85), |

in which P may be an oxygen-reinforced peroxide stage $P_o$ in which the peroxide dosage is over 5 kg $H_2O_2$/adt, preferably 5 to 20 kg $H_2O_2$/adt, and the oxygen dosage 0 to 10 kg $O_2$/adt, or a peroxide-reinforced oxygen stage $O_p$, in which the peroxide dosage is below 10 kg $H_2O_2$/adt and the oxygen dosage over 5 kg $O_2$/adt, preferably 5 to 15 kg/adt. In a sequence comprising several peroxide stages P, the first P stage should preferably be a peroxide-reinforced oxygen stage $O_p$ and the second P stage an oxygen-reinforced peroxide stage $P_o$. The peroxide stage may also be an acidic P stage $P_a$, whereby bleaching is effected, e.g., by Caro's acid or peracid. In other words, the sequences may also be the following:

Cooking-O-AQ-$P_a$-AQ-P,

Cooking-O-AQ-$P_a$-ZQ-P,

Cooking-O-AQ-ZQ-$P_a$-ZP, or

Cooking-O-AQ-$P_a$-ZP.

The above-identified sequences may be simplified by leaving out washers. Washing before the A, Q, or AQ stages is not always necessary f or the process, even though the consumption of acid increases, but often this is not too expensive in comparison with the washer price. Therefore, marking "-" which usually indicates washing and/or pressing, may be left out before the A and/or Q stages. Thus, e.g., the partial sequence P-AQ is replaced with a partial sequence PAQ, or possibly with PA or PQ.

Thereby, e.g., the following sequences may also be considered:

| | |
|---|---|
| Cooking - O - AQ - PQ - P | (brightness over 88), |
| Cooking - O - AQ - PQ - ZP | (brightness over 88), |
| Cooking - O - AQ - ZPQ - ZP | (brightness over 88), |
| and | |
| Cooking - O - PAQ - P | (brightness over 85) |

As in the above-mentioned sequences, PQ may also in these sequences be $P_aQ$, whereby $P_a$ means acidic peroxide stage, i.e., treatment with, e.g., Caro's acid or peracid.

The following exemplary sequences are also possible:

Cooking-O-AQ-$P_a$Q-P,

Cooking-O-AQ-$P_a$Q-ZP,

Cooking-O-AQ-Z$P_a$Q-ZP, or

Cooking-O-A$P_a$Q-P.

Another simplification, which is worth while sometimes, is to replace AQ, PQ, $P_aQ$, or ZQ with either A, P, $P_a$, or Z. This can be done when metal removal is even otherwise sufficient. When there are two Q stages in the sequence, one of them, preferably the first one, may sometimes be left out. The kappa number after cooking is 35–15 or even less. At the oxygen stage, pulp is delignified to a kappa number below 20, preferably below 10. So, it is typical to a method according to a preferred embodiment of the invention that the method is applied to a pulp, the kappa number of which has, by cooking and potentially also by delignification, been brought to a value below 20, preferably below 10.

The A stage may be intensified by adding some chemical which advances bleaching or some bleaching chemical to it. It may be, for example, some enzyme or chlorine dioxide. It has to be noted, however, that the above-mentioned decrease of the kappa number by 1–9 units at the A stage may be reached without the additional chemicals mentioned here, so, the additional chemicals are only used for making the decrease of kappa number more efficient. Then, the A stage may be $A_{Enzyme}$ ($A_E$) or $A_{Dioxide}$ ($A_D$). When enzyme is added to the A stage, a suitable pH is 4 to 5, and a suitable temperature 70 to 90° C. When chlorine dioxide is added to the A stage, a suitable end pH is 3 to 5 and the initial pH a little (2 to 4 units) higher. A suitable temperature is 80 to 100° C. when dioxide is used. If chlorine dioxide is added, it may be worth while destroying the chlorine dioxide residuals with $SO_2$ or NaOH before adding the chelating agent, to prevent the chelating agent from becoming destroyed. In the above-identified sequences, A may thereby be $A_E$ or $A_D$ or some other intensified A stage.

EXAMPLE

In test runs, both hardwood and softwood pulps were cooked and delignified to a kappa number of approx. 10. Thereafter, the pulps were treated at an acid stage, where the temperature was 100° C., pH 3 to 4, and treatment time 3 hours. After acid treatment, the pulps were treated with EDTA at the pH of 5.5 to 6.5. After this, the kappa numbers were measured. The kappa number of hardwood pulp ranged from 7 to 5 and that of softwood pulp from 8 to 6.

When chlorine dioxide was added to the acid stage, it was possible to further reduce the kappa number by 1–4 units. It was established in the test that a suitable dosage was 5 to 30 kg, preferably 10 to 20 kg, of chlorine dioxide per pulp ton calculated as active chlorine.

After the acid stage, the pulps were bleached at a pressurized peroxide stage, and this AQ-P treatment resulted in brightness values of over 85. In other words, it could be established that, when the treatment was started with a pulp having a sufficiently low kappa number, the brightness values obtained were clearly higher than those mentioned in the above-identified sequences.

When bleaching was carried out with the $A_DQ$-P combination, the brightness values of over 88 were obtained the dosage of chlorine dioxide being 10 to 20 kg/ADMT.

During continued test runs, it was surprisingly found out that when chlorine dioxide was not added directly to the A stage but the kappa number was first allowed to drop by mere acid treatment, and chlorine dioxide was added only after that, this gave a better final result. In other words, AD is a more efficient treatment than $A_D$ and gives a kappa number which is 2 to 4 units lower. With a partial sequence ADQ-P, the chlorine dioxide dosage being 10 to 20 kg/adt calculated as active chlorine, a brightness of 89 to 90 ISO was achieved.

A corresponding phenomenon was discovered when peracids, such as peracetic acid and Caro's acid, were used. With an acidic $P_a$ stage, a good result is obtained with the partial sequence A$P_a$-P or A$P_a$Q-P. The explanation to this is that, at the A stage are removed also hexenuronic acids, which, unless they were removed, would consume chlorine dioxide, peracetic acid, Carols acid, ozone, and other bleaching chemicals. In other words, in view of the overall economy, it is advantageous that also hexenuronic acids are removed at the A stage and that the oxidizing chemical is added thereafter, the addition thereof being a treatment stage of its own.

Figure 2:
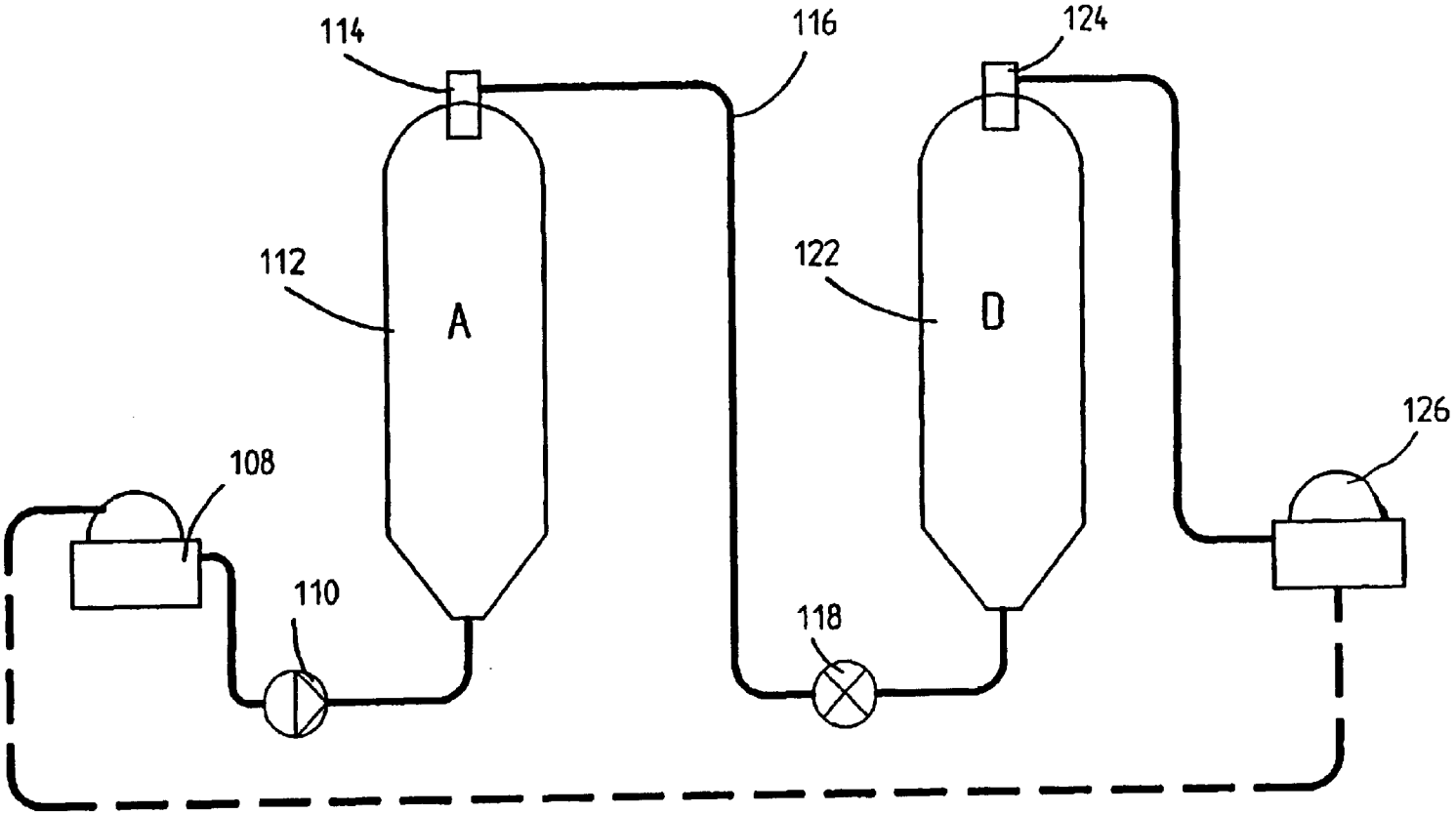
FIG. 2 illustrates an installation according to a second preferred embodiment of the invention.

The bleaching stage illustrated in FIG. 2, being in accordance with an alternative embodiment and being used in the above-mentioned continuation tests, includes a pump 110, preferably a so-called MC® pump, for pumping pulp, which is preferably in a medium consistency, from some preceding treatment stage, for example, a washer 108 or a press, to a first treatment tower 112. From tower 112, pulp is discharged, preferably but not necessarily, via a top discharge means to a second treatment tower 122. If the top discharge means is used, it may preferably be such that it raises pressure to some extent, 0.1 to 10, preferably 1 to 5 bar, so that the pressure generated by it may be used for transferring pulp from one tower to another. The discharge means 114 may also be provided with gas separating devices in accordance with A. Ahlstrom Corporation's patent applications PCT/FI90/00085 or PCT/FI92/00216. It is a characteristic feature of the embodiment shown in FIG. 2 of the invention that the first treatment tower 112 is intended for acid treatment (A), whereby the acid (preferably sulphuric acid or some organic acid such as aminic acid) is fed and mixed with the pulp, preferably in pump 110. The need for acid may be considerably decreased by bringing filtrate to the washer 108 preceding the described AD stage from the washer 126 (illustrated by a dashed line in FIG. 2) subsequent to the AD (acidic) stage. So, acid is only needed for adjusting the pH to a value as exactly desired. When pulp is being discharged from tower 112, alkali is mixed with it, for adjusting the pH of the pulp, either in top discharge means 114 or thereafter or in a separate mixer. Preferably, a pipeline 116 combining the towers 112 and 122 is provided with a mixer 118, by which chlorine dioxide is mixed with pulp. In other words, tower 122 is a chlorine dioxide tower. The purpose of the chlorine dioxide is to activate pulp for further bleaching treatments.

So, the above treatment stage is composed of two phases, A and D, carried out using two different chemicals. The first phase may be called, for example, an acid phase. Its purpose is to improve the bleachability of pulp, and it is typically conducted in the following process conditions:

consistency 8 to 20% temperature 80 to 110° C.

pH 3 to 5, and treatment time 30 to 120 min, whereby the kappa number of pulp decreases by 1–6 units in said A phase.

It has been established on the basis of laboratory tests that with softwood pulp, the decrease of kappa number is about 1–3 units and with hardwood pulp about 2–6 units. Pulps of both type have been cooked and thereafter oxygen-delignified so that the kappa number is below 18, preferably below 12. On the basis of the tests, it has been established that the A stage is most advantageous for a pulp pretreated in this manner.

A second phase of the AD stage is D, and its process conditions are typically as follows:

consistency 8 to 20%.

temperature 70 to 100° C. (may be higher)

initial pH 6 to 9 final pH 3 to 5 treatment time 10 to 180 min chlorine dioxide dosage 5 to 30 kg $ClO_2O$/adt, and chemicals adjusting the metal profile, such as Mg, Ca, EDTA, DTPA etc., may be used in either the D phase or, e.g, thereafter.

It has to be noted that the A and D phases, both those described above and those to be mentioned later, may be carried out in reverse order, i.e., all AD stages or AD partial stages may be implemented in order DA, their effect being in that case, however, probably weaker.

Sequences applying the AD stage may be, e.g.:

O-AD-E-D, and O-AD-E-$D_E$-D, and O-AD-$P_o$.

The oxygen delignification stage O may be left out if the kappa number of the pulp coming from the cooking stage is sufficiently low.

According to a third preferred embodiment of the invention, use of chlorine dioxide may also be included in a sequence which uses peroxide and chelation treatment prior to that. As known, chelation treatment (Q) means treating pulp with chelates (e.g., EDTA, DTPA or the like), which treatment is intended for removing heavy metals from pulp, such heavy metals being, e.g., iron, copper, and manganese so that they cannot dissolve peroxide. Suitable conditions for chelation treatment incorporate pH of 4 to 6, treatment time of 10 to 60 minutes and treatment temperature of 60 to 100° C.

Figure 3:
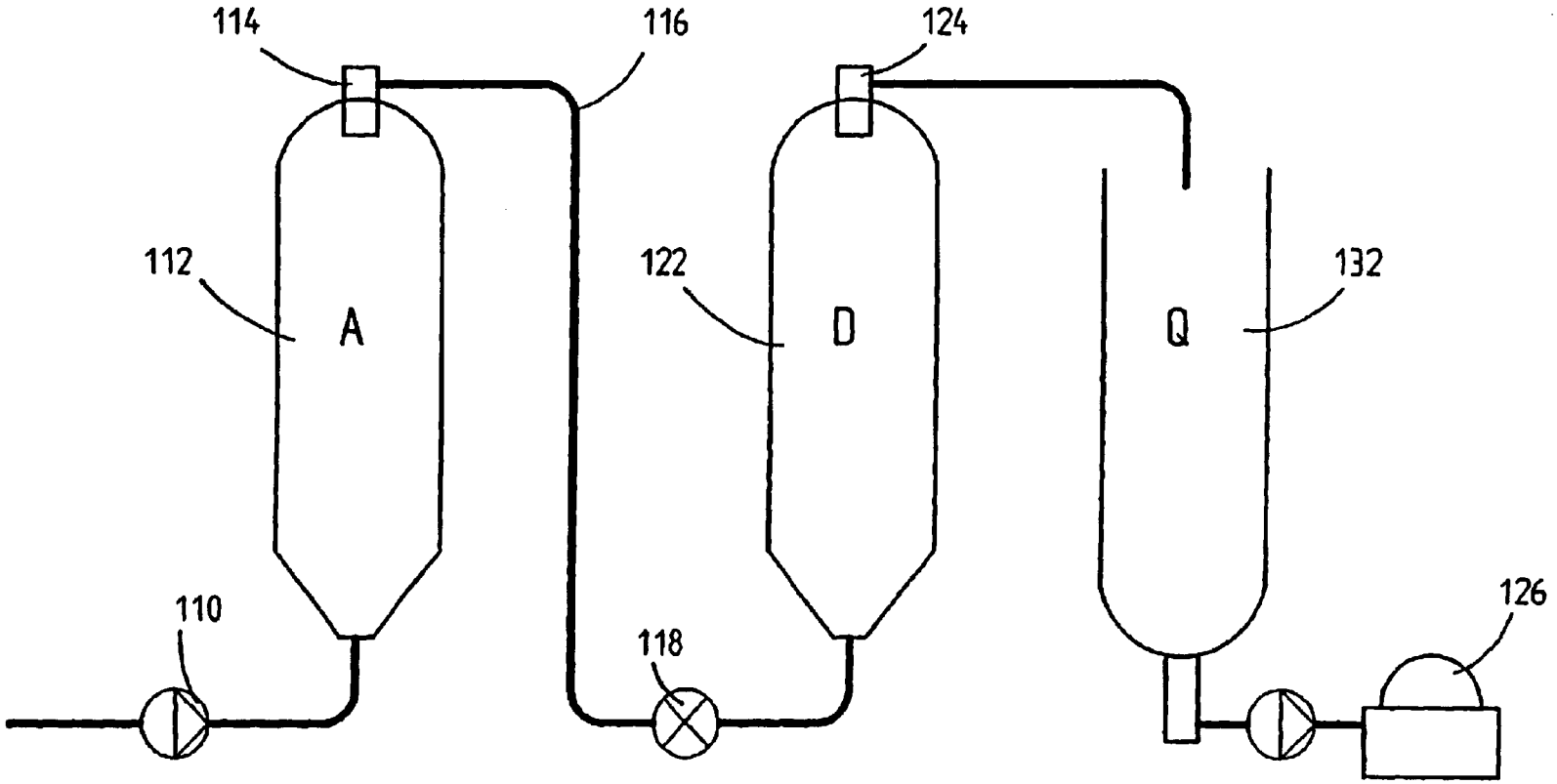
FIG. 3 illustrates an installation according to a third embodiment of the invention.

When the peroxide stage P is used, pulp is preferably first treated in tower combination DQ or possibly ADQ, for removing heavy metals, as illustrated in FIG. 3. In some cases, particularly when chelating agents are not desired to be used, the tower combination AD as shown in FIG. 2 is used also for removing heavy metals. FIG. 3 illustrates three successive towers, 112, 122, and 132. The first of the towers is an acid treatment tower 112 and, as mentioned earlier, it is only used according to need (for example, if the kappa number of pulp has to be lowered). As for the second tower 122, the embodiment of FIG. 3 corresponds to FIG. 2. However, from the second tower 122, pulp is discharged preferably to an open chelation tower 132, and after having been treated therein, pulp is cleaned of heavy metals by washing them off of the pulp in washer 126. Also towers 122 and 132 may be provided with heat transfer surfaces 120, whereby the temperature in different towers may be selected without any direct use of steam.

Sequences O-DQ-$P_o$ or O-ADQ-$P_o$, implemented with the above described arrangement of towers, give quite high brightness values. According to laboratory tests, the brightness values obtained by using said sequences are over 85 ISO. Brightness may be further increased by adding D, Z, or $P_o$ stages. Sequences which are longer and produce a higher brightness value are thereby, e.g., O-D-E-DQ-$P_o$, or O-DQ-$P_o$-DQ-$P_o$. Mg, Ca, and other chemicals for making the metal profile more even, may be added to the chlorine dioxide stage. In this way, DQ may possibly be replaced by mere D, to which one or more chemicals, such as Mg, Ca, EDTA, DTPA, have been added. Thus, DQ may mean an intensified D stage with regard to metals treatment. It is also advantageous to combine the A treatment with D stages in these sequences so that the D stage is replaced with an AD stage and the DQ stage with an ADQ stage.

As can be seen from the above description, the pretreatment stages preceding the peroxide stages according to the invention are very simple and, on the other hand, also effective. As, for example, each treatment stage (A and Q) is effected at a pH which is exactly as required by it, the efficiency of the stages is brought to a maximum. However, the pressurizing of the pretreatment stage/pretreatment stages has resulted in that the investments in equipment remain relatively low, because the number of pumps has been minimized. In comparison with some earlier suggestions, the method of the invention also brings a saving of at least one washer, because earlier it was suggested to have a washing stage also between the acidification and chelation. It has to be noted, however, that only some preferred, exemplary embodiments have been described above, and that they are by no means intended to limit the scope of our invention, which is presented in the accompanying claims.

What is claimed is:

1. A method of pre-treating, prior to bleaching with peroxide, cellulose pulp, to improve bleachability of the pulp, using an acid tower, and a tower in a second treatment stage, comprising the steps of substantially sequentially:

(a) if necessary, adjusting the pH of the pulp to between 2–6 by adding aminic acid, sulfuric acid, hydrochloric acid or another acid which does not contain oxidizing perhydroxyl ions;

(b) feeding the pulp to the acid tower;

(c) treating the pulp in the acid tower at substantially the pH, between 2–6, to which it has been adjusted in step (a), at a pressure of 0–20 bar, at a temperature of 75–130° C., and for 20–240 minutes, so that acid treatment decreases the kappa number by 1–9 units;

(d) transferring the pulp from the acid tower to the tower of the second treatment stage, (e) in the second treatment stage tower treating the pulp with a complexing agent at a pH of between 4–9;

(f) washing, pressing, or both washing and pressing the pulp; and (g) bleaching the pulp with hydrogen peroxide using 5 to 20 kg peroxide/adt and 0–15 kg oxygen/adt, wherein step (f) is practiced by washing the pulp in a fractionating washer so that a first filtrate containing heavy metals is removed from the process, and a second, cleaner, filtrate is recycled for use in another stage of the method.

2. A method as recited in claim 1 wherein step (g) is practiced using two towers which are different in size and connected to each other, the first tower acting as a pretreatment reactor and the second tower as a bleach tower.

3. A method as recited in claim 2 wherein step (g) is further practiced by: mixing peroxide with the pulp; feeding the pulp into the pretreatment reactor and treating the pulp in the pretreatment reactor at a pressure of 3–20 bar and for a reaction time of 10–60 minutes, so that the peroxide reacts with the pulp; separating gas from the pulp; using the pressure in the pretreatment reactor, blowing the pulp to a lower section of the bleach tower so that the pulp flows upwardly in the bleach tower; and removing the pulp from the top of the bleach tower after the pulp reacts with the peroxide in the bleach tower.

4. A method as recited in claim 3 wherein the mixing step is practiced by adding 5–20 kg/adt peroxide, and 0–10 kg/adt oxygen to the pulp.

5. A method as recited in claim 3 wherein step (g) is further practiced by using a peroxide dosage that is from about 5 to just below 10 kg/adt, and using an oxygen dosage of between 5–15 kg/adt.

6. A method as recited in claim 3 wherein during treatment of the pulp in the bleach tower the pressure is between 1.1–5 bar, and the temperature 80–130° C.

7. A method of pre-treating, prior to bleaching with peroxide, cellulose pulp, to improve bleachability of the pulp, using an acid tower, and a tower in a second treatment stage, comprising the steps of substantially sequentially:

(a) if necessary, adjusting the pH of the pulp to between 2–6 by adding aminic acid, sulfuric acid, hydrochloric acid or another acid which does not contain oxidizing perhydroxyl ions;

(b) feeding the pulp to the acid tower;

(c) treating the pulp in the acid tower at substantially the pH, between 2–6, to which it has been adjusted in step (a), at a pressure of 0–20 bar, at a temperature of 75–130° C., and for 20–240 minutes, so that acid treatment decreases the kappa number by 1–9 units;

(d) transferring the pulp from the acid tower to the tower of the second treatment stage, (e) in the second treatment stage tower treating the pulp with a complexing agent at a pH of between 4–9;

(f) washing, pressing, or both washing and pressing the pulp; and (g) bleaching the pulp in two stages using peroxide, the first stage in sequence using a peroxide dosage of between 5 to just below 10 kg/adt and with about 5–15 kg/adt oxygen, and the second peroxide stage in sequence having a dosage of 10–20 kg/adt peroxide and an oxygen dosage of 0–10 kg/adt.

8. A method of pre-treating, prior to bleaching with peroxide, cellulose pulp, to improve bleachability of the pulp, using an acid tower, and a tower in a second treatment stage, comprising the steps of substantially sequentially:

(a) if necessary, adjusting the pH of the pulp to between 2–6 by adding aminic acid, sulfuric acid, hydrochloric acid or another acid which does not contain oxidizing perhydroxyl ions;

(b) feeding the pulp to the acid tower;

(c) treating the pulp in the acid tower at substantially the pH, between 2–6, to which it has been adjusted in step (a), at a pressure of 0–20 bar, at a temperature of 75–130° C., and for 20–240 minutes, so that acid treatment decreases the kappa number by 1–9 units;

(d) transferring the pulp from the acid tower to the tower of the second treatment stage, (e) in the second treatment stage tower treating the pulp with a complexing agent at a pH of between 4–9;

(f) washing, pressing, or both washing and pressing the pulp; and (g) bleaching the pulp with hydrogen peroxide using 5 to 20 kg peroxide/adt and 0–15 kg oxygen/adt, wherein steps (a) through (g) are practiced to produce pulp at an ISO brightness of over 88, and is a part of the treatment sequence of Cooking-O-AQ-$P_a$Q-P.

9. A method of pre-treating, prior to bleaching with peroxide, cellulose pulp, to improve bleachability of the pulp, using an acid tower, and a tower in a second treatment stage, comprising the steps of substantially sequentially:

(a) if necessary, adjusting the pH of the pulp to between 2–6 by adding aminic acid, sulfuric acid, hydrochloric acid or another acid which does not contain oxidizing perhydroxyl ions;

(b) feeding the pulp to the acid tower;

(c) treating the pulp in the acid tower at substantially the pH, between 2–6, to which it has been adjusted in step (a), at a pressure of 0–20 bar, at a temperature of 75–130° C., and for 20–240 minutes, so that acid treatment decreases the kappa number by 1–9 units;

(d) transferring the pulp from the acid tower to the tower of the second treatment stage, (e) in the second treatment stage tower treating the pulp with chlorine dioxide and adding chemicals to the pulp to adjust the metal profile of the pulp prior to, or in combination with, the chlorine dioxide treatment;

(f) washing, pressing, or both washing and pressing the pulp; and (g) bleaching the pulp using hydrogen peroxide.

10. A method as recited in claim 9 wherein step (c) is practiced at a pH between about 3–4, at a temperature of 80–110° C., for a time of 30–180 minutes, and so that acid treatment decreases the kappa number of the pulp by at least 2 units.

11. A method as recited in claim 10 wherein step (e) is practiced using a complexing agent at a pH of between about 4–9.

12. A method as recited in claim 9 wherein step (g) is practiced by treating with hydrogen peroxide alone in a stage, or by adding hydrogen peroxide to an alkaline stage.

13. A method as recited in claim 11 wherein prior to step (e), between steps (c) and (e), adding acid or alkali to the pulp to adjust the pH thereof.

14. A method as recited in claim 9 wherein step (f) is practiced by washing the pulp in a fractionating washer so that a first filtrate containing heavy metals is removed from the process, and a second, cleaner, filtrate is recycled for use in another stage of the method.

15. A method as recited in claim 9 wherein step (g) is practiced using two towers which are different in size and connected to each other, the first tower acting as a pretreatment reactor and the second tower as a bleach tower.

16. A method as recited in claim 15 wherein step (g) is further practiced by: mixing peroxide with the pulp; feeding the pulp into the pretreatment reactor and treating the pulp in the pretreatment reactor at a pressure of 3–20 bar and for a reaction time of 10–60 minutes, so that the peroxide reacts with the pulp; separating gas from the pulp; using the pressure in the pretreatment reactor, blowing the pulp to a lower section of the bleach tower so that the pulp flows upwardly in the bleach tower; and removing the pulp from the top of the bleach tower after the pulp reacts with the peroxide in the bleach tower.

17. A method as recited in claim 9 wherein step (g) is practiced in two stages using peroxide, the first stage in sequence using a peroxide dosage of between 5 to just below 10 kg/adt and with about 5–15 kg/adt oxygen, and the second peroxide stage in sequence having a dosage of 10–20 kg/adt peroxide and an oxygen dosage of 0–10 kg/adt.

18. A method as recited in claim 9 wherein step (e) is practiced by using 5–30 kg/adt chlorine dioxide calculated as active chlorine.

19. A method as recited in claim 9 wherein steps (a) through (g) are practiced as part of a treatment sequence of the pulp, in which the steps are practiced to bleach the pulp to an ISO brightness of over 80, comprising Cooking-O-AD-P, or Cooking O-ADQ-P.

* * * * *